US007204768B2

(12) United States Patent
Nakahara et al.

(10) Patent No.: US 7,204,768 B2
(45) Date of Patent: Apr. 17, 2007

(54) HOLLOW GOLF CLUB HEAD

(75) Inventors: Norihiko Nakahara, Hiratsuka (JP); Tomoaki Mori, Hiratsuka (JP); Masahiko Miyamoto, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 11/203,100

(22) Filed: Aug. 15, 2005

(65) Prior Publication Data

US 2006/0035720 A1 Feb. 16, 2006

Related U.S. Application Data

(62) Division of application No. 10/329,434, filed on Dec. 27, 2002, now Pat. No. 6,945,876.

(30) Foreign Application Priority Data

Dec. 28, 2001 (JP) ..... 2001-399407

(51) Int. Cl.
*A63B 53/04* (2006.01)

(52) U.S. Cl. ..... 473/329; 473/345; 473/349

(58) Field of Classification Search ..... 473/345, 473/349

See application file for complete search history.

(56) References Cited

U.S. PATENT DOCUMENTS 4,021,047 A 5/1977 Mader
4,667,963 A * 5/1987 Yoneyama ..... 473/348
4,798,383 A 1/1989 Nagasaki et al.
4,874,171 A * 10/1989 Ezaki et al. ..... 473/290
5,000,454 A 3/1991 Soda
5,303,922 A 4/1994 Lo
5,328,176 A 7/1994 Lo
5,499,814 A 3/1996 Lu
5,586,944 A * 12/1996 Nagamoto et al. ..... 473/248
5,624,331 A 4/1997 Lo et al.
5,643,103 A 7/1997 Aizawa
5,658,207 A * 8/1997 Aizawa et al. ..... 473/345
5,669,827 A 9/1997 Nagamoto
5,766,089 A * 6/1998 Dekura ..... 473/305
5,830,084 A 11/1998 Kosmatka
6,193,614 B1 2/2001 Sasamoto et al.
6,334,817 B1 * 1/2002 Ezawa et al. ..... 473/324
6,344,817 B1 * 2/2002 Verzulli ..... 341/176
6,575,845 B2 6/2003 Galloway et al.
2003/0032500 A1 2/2003 Nakahara et al.
2003/0083151 A1 5/2003 Nakahara et al.

(Continued)

*Primary Examiner*—Sebastiano Passaniti
(74) *Attorney, Agent, or Firm*—Finnegan, Henderson, Farabow, Garrett & Dunner, L.L.P.

(57) ABSTRACT

A hollow golf club head allowing to increase the repulsion and the degree of design freedom, while maintaining the durability. A hollow golf club head having a head body formed from a metal, wherein a hole is formed in the vicinity of the middle of a crown portion in the head body, the hole is closed with a cover member made of a material different from the head body, the ratio (ρm/ρf) of the specific gravity ρm of the head body and the specific gravity ρf of the cover member is set equal or superior to 1.3, and the ratio of the face area of a portion where the reinforcement and the head body are combined to the face area of the head body is set equal or superior to 20%.

2 Claims, 10 Drawing Sheets

U.S. PATENT DOCUMENTS

2003/0125127 A1 7/2003 Nakahara
2003/0134693 A1 7/2003 Nakahara et al.
2004/0116207 A1 6/2004 Shiell et al.
2004/0116208 A1 6/2004 Shiell et al.

* cited by examiner

HOLLOW GOLF CLUB HEAD

RELATED APPLICATION

This application is a divisional of U.S. application Ser. No. 10/329,434 filed Dec. 27, 2002 now U.S. Pat. No. 6,945,876, the contents of which is incorporated herein by reference.

BACKGROUND OF THE INVENTION

The present invention concerns a golf club head having a hollow structure, and more particularly, a hollow golf club head having a higher repulsion and a greater degree of design freedom, compared to a case of composing solely with a single metallic material, by combining different kinds of materials, while keeping the durability.

For the metallic hollow golf club heads, it is planned to lower the center of gravity generally by broadening the weight distribution to the sole portion. However, in recent years, the weight margin for lowering the center of gravity is reduced and the degree of design freedom is reduced, because it is required to increase the head volume as much as possible in a limited head volume. There, if the center of gravity is not lowered in the head sufficiently, there is a problem that the repulsion of the face surface can not be utilized maximally.

By the way, Japanese Patent No. 2764883, Japanese patent application Kokai publication No. 2000-229135, and Japanese Patent No. 2773009 disclose a golf club head made by combining different materials. However, even in these golf club heads where characteristics of different kinds of materials are combined, the degree of design freedom or the repulsion has been still insufficient.

SUMMARY OF THE INVENTION

An object of the present invention is to provide a hollow golf club head having a higher repulsion and a greater degree of design freedom, compared to a case of composing solely with a single metallic material, by combining different kinds of materials, while keeping the durability.

The hollow golf club head of the present invention for attaining the aforementioned object is a hollow golf club head having a head body formed from a metal, wherein a hole is formed in the vicinity of the middle of a crown portion in the head body, the hole is closed with a cover member made of a material different from the head body, the ratio ($\rho m/\rho f$) of the specific gravity $\rho m$ of the head body and the specific gravity $\rho f$ of the cover member is set equal or superior to 1.3, the face portion of the head body is laminated with a reinforcement made of fiber reinforced plastic, and the ratio of the face area of a portion where the reinforcement and the head body are combined to the face area of the head body is set equal or superior to 20%.

Also, the hollow golf club head of the present invention for attaining the aforementioned object is a hollow golf club head having a head body formed from a metal, wherein holes are formed respectively in the vicinity of the middle of a crown portion and a sole portion in the head body, each of the holes is closed with a cover member made of a material different from the head body, the ratio ($\rho m/\rho f$) of the specific gravity $\rho m$ of the head body and the specific gravity $\rho f$ of the cover member is set equal or superior to 1.3, the face portion of the head body is laminated with a reinforcement made of fiber reinforced plastic, and the ratio of the face area of a portion where the reinforcement and the head body are combined to the face area of the head body is set equal or superior to 20%.

A greater weight margin can be secured, by providing a hole in the crown portion or both crown portion and sole portion of the head body, closing the hole with a cover member made of a material different from the head body, and setting the ratio ($\rho m/\rho f$) of the specific gravity $\rho m$ of the head body and the specific gravity $\rho f$ of the cover member equal or superior to 1.3 in this manner. Consequently, the degree of design freedom is increased compared to a case of composing solely with a single metallic material and, as a result, it becomes possible to increase the repulsion by lowering the center of gravity. Also, it becomes possible to further improve the repulsion by thinning as much as possible the metallic part of the face portion, while maintaining the durability, as the face portion of the head body is laminated with a reinforcement made of fiber reinforced plastic, and the ratio of the face area of a portion where the reinforcement and the head body are combined to the face area of the head body is set equal or superior to 20%.

In the present invention, it is preferable to laminate the reinforcement inside the face portion of the head body, in order not to deteriorate the repulsion based on the metallic material of the face portion and the resistance to external damage of the face surface. Besides, it is good to thin the metallic part of the face portion depending on the kinds of metal, in order to obtain a more excellent repulsion. For instance, in case where the material composing the face portion of the head body is a titanium alloy, the thickness of the titanium alloy of the face portion is preferably equal or less than 3.0 mm. In case where the material composing the face portion of the head body is an iron alloy, the thickness of the iron alloy of the face portion is preferably equal or less than 2.5 mm. In case where the material composing the face portion of the head body is an aluminum alloy, the thickness of the aluminum alloy of the face portion is preferably equal or less than 4.0 mm.

On the other hand, the coefficient of elasticity of the fiber of the fiber reinforced plastic composing the reinforcement is preferably equal or less than 35 tons/mm$^2$, in order to secure a sufficient resistance to an impact.

The material of the cover member is not particularly limited, provided that it meets the aforementioned specific gravity relationship; however, it is preferable to make the total mass Wf of the cover member closing the hole lighter than the total mass Wx of the removed portion of the head body determined from the product of the virtual area of the hole, the virtual thickness of the hole and the specific gravity $\rho m$ of the head body, independently of the material to be used, in order to secure the weight margin.

In the present invention, though it is preferable to close the hole provided in the head body with a cover member, it is also possible to compose a hollow golf club head having the other composite structure. In short, the hollow golf club head of the present invention is characterized by that at least a part of the crown portion and a part of the face portion of the head body is composed of a material different from the head body, and the ratio ($\rho b/\rho c$) of the specific gravity $\rho b$ of a portion of the head body excluding the crown portion and the face portion and the specific gravity $\rho c$ of the crown portion is set equal or superior to 1.3.

Thus, it becomes possible to secure a greater weight margin, by the fact that at least a part of the crown portion and a part of the face portion of the head body are composed of a material different from the head body, and the ratio ($\rho b/\rho c$) of the specific gravity $\rho b$ of a portion of the head body excluding the crown portion and the face portion and the specific gravity ρc of the crown portion is set equal or superior to 1.3. Consequently, the degree of design freedom is increased compared to a case of composing solely with a single metallic material and, as a result, it becomes possible to increase the repulsion by lowering the center of gravity.

BRIEF DESCRIPTION OF THE DRAWINGS

FIG. 1(*a*) is a plan view, FIG. 1(*b*) a front view, and FIG. 1(*c*) is a cross sectional view taken along line I—I in FIG. 1(*a*);

FIG. 2(*a*) is a plan view, FIG. 2(*b*) a front view, and FIG. 2(*c*) is a cross sectional view taken along line II—II in FIG. 2(*a*);

FIG. 6(*a*) is a plan view, and FIG. 6(*b*) is a cross sectional view taken along line VI—VI in FIG. 6(*a*);

FIG. 7(*a*) is a plan view, and FIG. 7(*b*) is a cross sectional view taken along line VII—VII in FIG. 7(*a*);

FIG. 10(*a*) is a plan view, FIG. 10(*b*) a front view, and FIG. 10(*c*) is a cross sectional view taken along line X—X in FIG. 10(*a*).

DETAILED DESCRIPTION OF THE PREFERRED EMBODIMENT

Now, the composition of the present invention shall be described in detail referring to attached drawings.

Figure 1A:
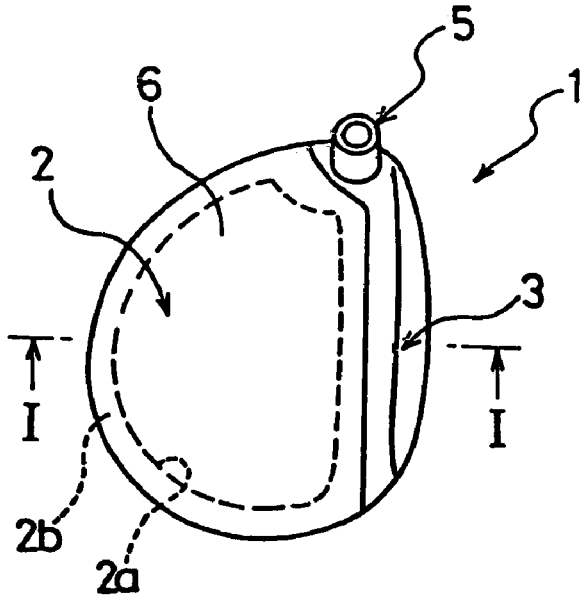
FIG. 1(*a*) to FIG. 1(*c*) show a golf club head made of a first embodiment of the present invention.
Figure 1B:
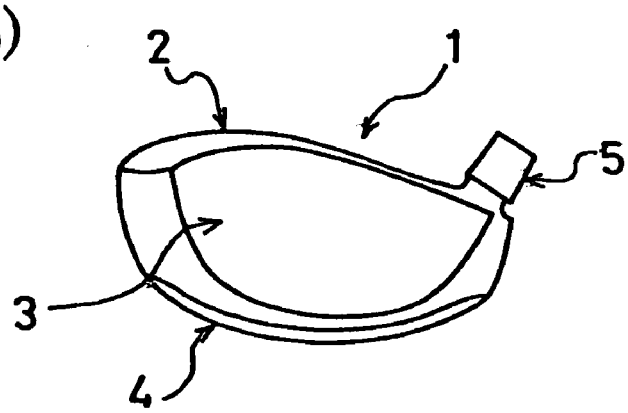
Figure 1C:
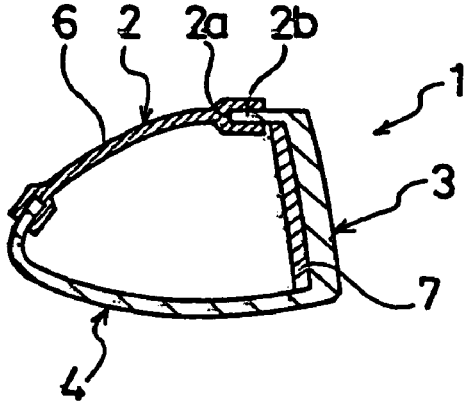

FIG. 1 (*a*) to FIG. 1 (*c*) show a golf club head made of a first embodiment of the present invention. As shown in FIG. 1 (*a*) to FIG. 1 (*c*), the golf club head of the present embodiment has a hollow structure, and a head body 1 thereof is composed of a metal such as titanium alloy, aluminum alloy, stainless steel or the like. The head body 1 has a crown portion 2, a face portion 3, a sole portion 4 and neck portion 5. While a hole 2*a* is formed in the vicinity of the middle of the crown portion 2, a flange portion 2*b* spreading over a hollow space is formed around the peripheral edge of the crown portion 2. There, the hole 2*a* is closed with a cover member 6 made of a material of a specific gravity lower than the head body 1. Besides, the inside of the face portion 3 of the head body 1 is laminated with a reinforcement 7 made of a fiber reinforced plastic.

Figure 2A:
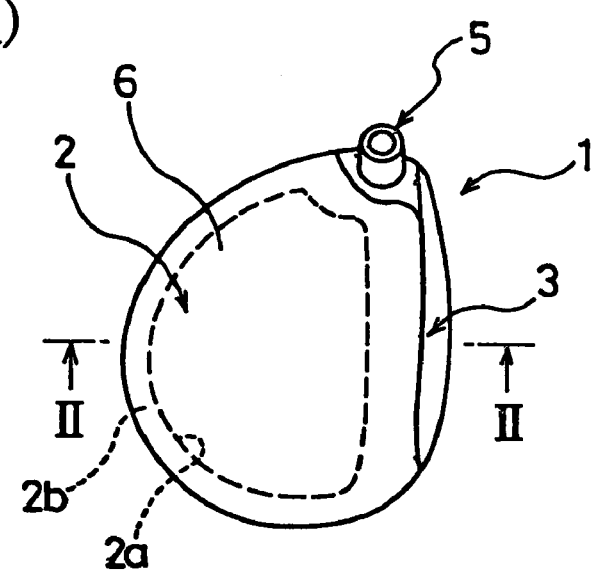
FIG. 2(*a*) to FIG. 2(*c*) show a golf club head made of a second embodiment of the present invention.
Figure 2B:
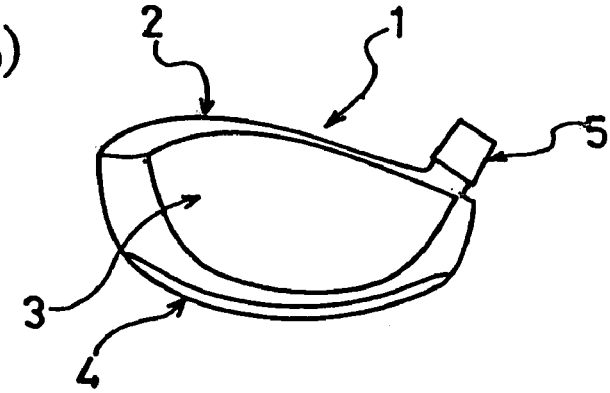
Figure 2C:
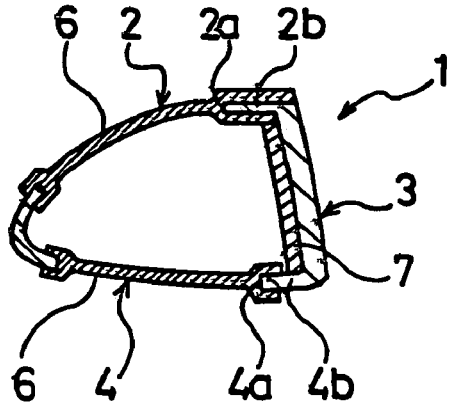
Figure 3A:
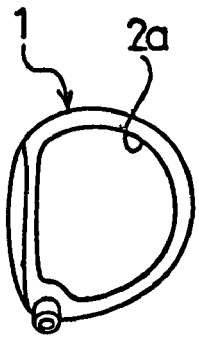
FIG. 3(*a*) to FIG. 3(*o*) are plan views showing respectively variants of golf club head of the present invention.
Figure 3B:
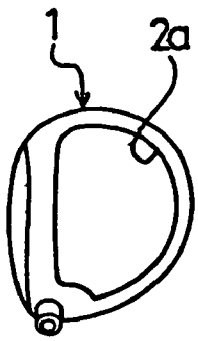
Figure 3C:
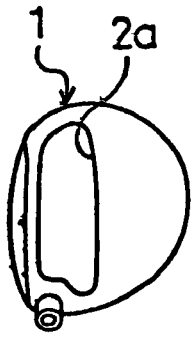
Figure 3D:
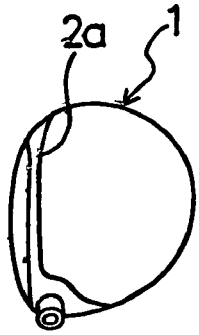
Figure 3E:
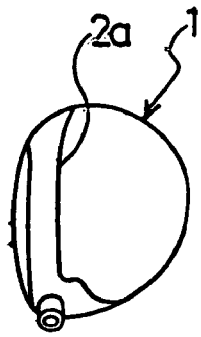
Figure 3F:
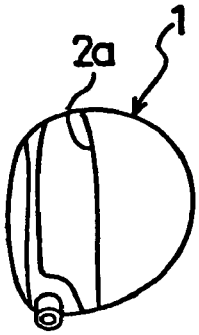
Figure 3G:
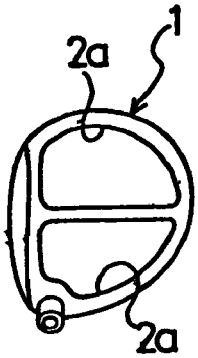
Figure 3H:
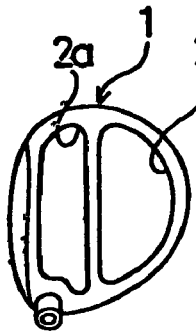
Figure 3I:
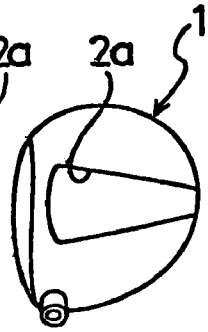
Figure 3J:
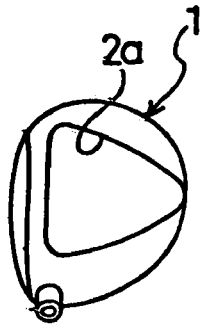
Figure 3K:
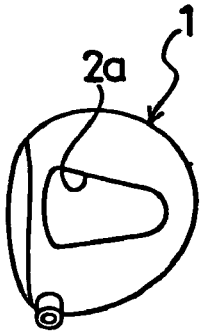
Figure 3L:
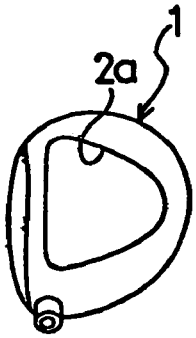
Figure 3M:
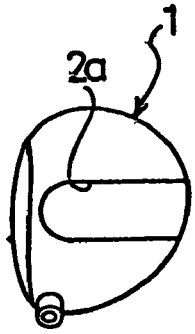
Figure 3N:
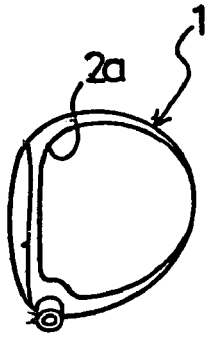
Figure 3O:
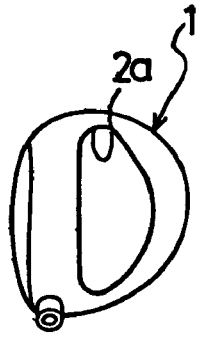
Figure 4A:
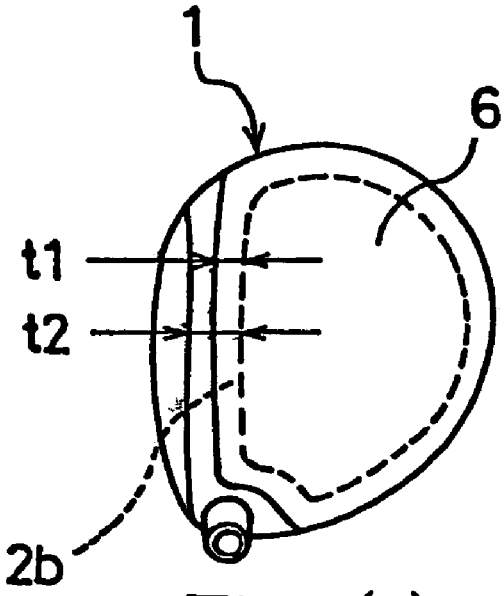
FIG. 4(*a*) to FIG. 4(*d*) are plan view showing respectively variants of golf club head of the present invention.
Figure 4B:
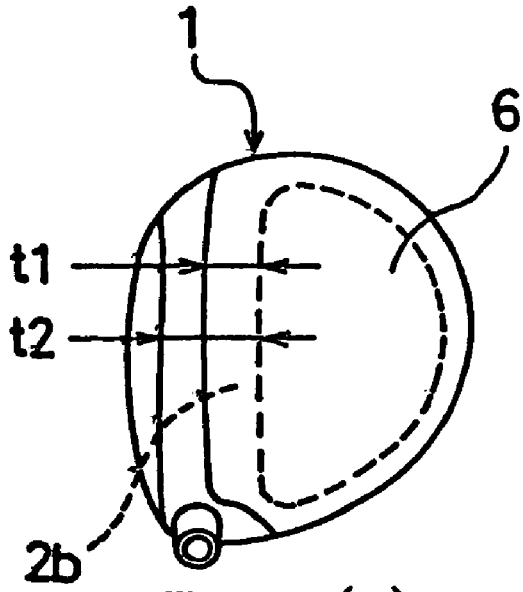
Figure 4C:
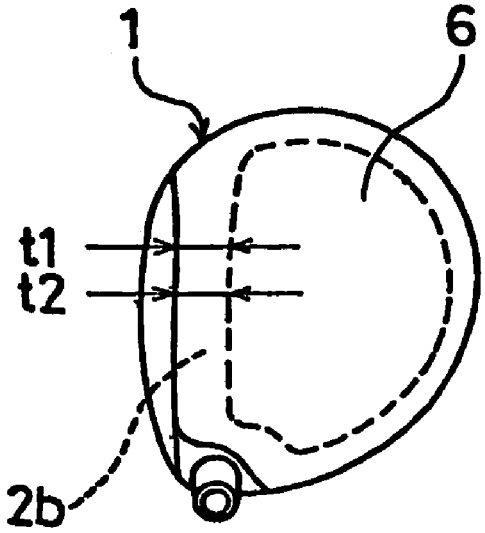
Figure 4D:
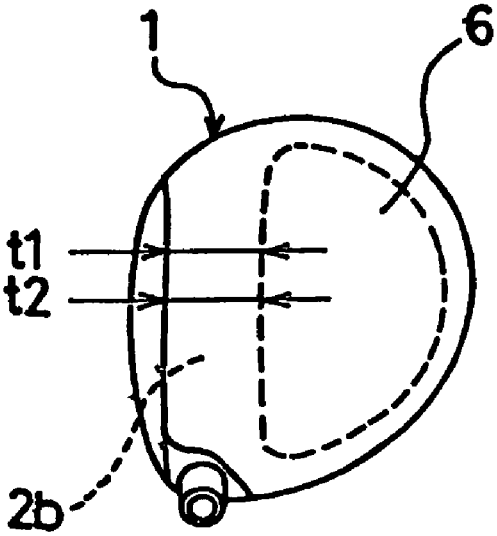
Figure 5A:
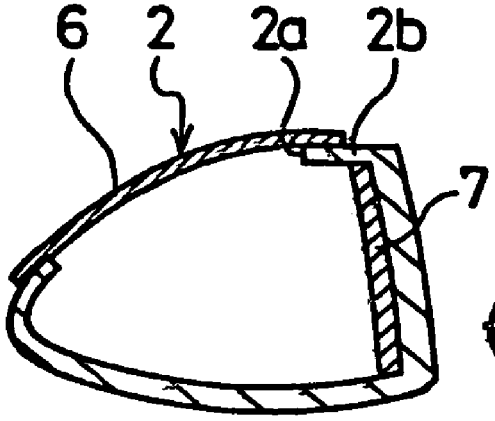
FIG. 5(*a*) to FIG. 5(*e*) are cross sectional view showing respectively variants of golf club head of the present invention.
Figure 5B:
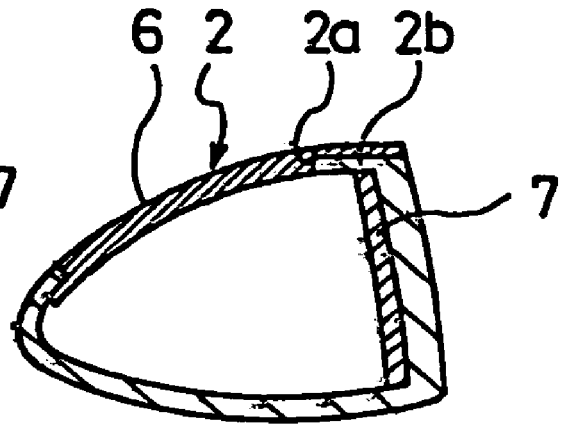
Figure 5C:
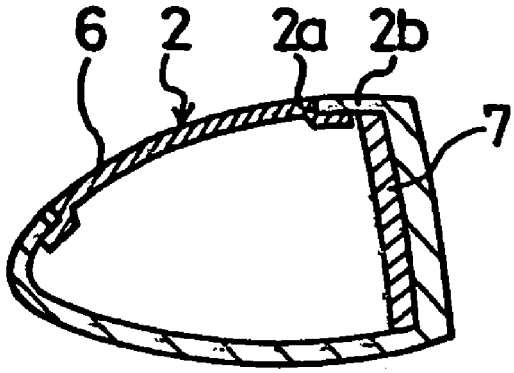
Figure 5D:
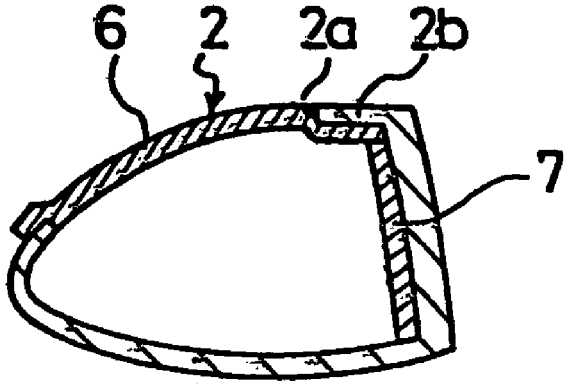
Figure 5E:
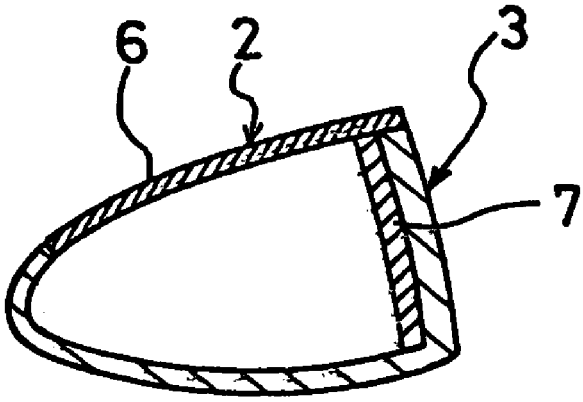

FIG. 2(*a*) to FIG. 2(*c*) show a golf club head made of a second embodiment of the present invention. As shown in FIG. 2(*a*) to FIG. 2(*c*), the golf club head of the present embodiment has a hollow structure, the head body 1 thereof is composed of a metal such as titanium alloy, aluminum alloy, stainless steel or the like. The head body 1 comprises a crown portion 2, a face portion 3, a sole portion 4 and a neck portion 5. While holes 2*a*, 4*a* are formed respectively in the vicinity of the middle of the crown portion 2 and the sole portion 4 in the head body, a flange 2*b* spreading over a hollow space is formed around the peripheral edge of the crown portion 2, and another flange 4*b* spreading under the hollow space is formed around the peripheral edge of the sole portion 4. And, the holes 2*a*, 4*a* are closed respectively with a cover member 6 made of a material lower than the head body 1 in specific gravity. Besides, the inside of the face portion 3 of the head body 1 is laminated with a reinforcement 7 made of a fiber reinforced plastic.

Thus, it becomes possible to secure a larger weight margin, and increase the degree of design freedom, by providing the hole 2*a* in the crown portion 2 of the head body 1 and further by providing a hole 4*a* in the sole portion 4 as necessary, and by closing the holes 2*a*, 4*a* with a cover member 6 made of a material lower than the head body 1 in specific gravity. Especially, when the crown portion 2 is provided with the cover member 6, it becomes possible to increase the moment of inertia and to lower the center of gravity by enlarging the weight margin, while in case of providing the cover member 6 in the sole portion 4, it becomes possible to increase the moment of inertia by enlarging the weight margin. Here, it is necessary to set the ratio (ρm/ρf) of the specific gravity ρm of the head body 1 and the specific gravity of the cover member 6 equal or superior to 1.3. If this ratio (ρm/ρf) is lower than 1.3, it becomes impossible to secure a sufficient weight margin. The upper limit of the ratio (ρm/ρf) is not particularly determined, but it is of the order of 16 from the combination of materials to be applied to now existing golf club heads.

Furthermore, it becomes possible to further improve the repulsion by thinning as much as possible the metallic part of the face portion 3, while maintaining the durability, as the face portion 3 of the head body 1 is laminated with a reinforcement 7 made of fiber reinforced plastic. Here, it is necessary to make the ratio (called, face combined area ratio, hereinafter) of the face area of the portion where the reinforcement 7 and the head body 1 are combined to the face area (area of hitting surface) of the head body 1 equal or superior to 20%. Here, the face area is the surface area of the portion surrounded by the edge of the face portion. Further, if the edge of is not clear, the edge of the face portion can also be known, by cutting the golf club head, and examining the bonded portion of the inner face. A good balance of the durability and the repulsion of a golf club head can be obtained by making the face combined area ratio equal or superior to 20%.

In case where the material composing the face portion 3 of the head body 1 is titanium alloy, the thickness of titanium alloy of the face portion 3 is preferably equal or inferior to 3.0 mm, more preferably equal or inferior to 2.5 mm, and still more preferably equal or inferior to 2.0 mm, setting the lower limit value thereof to 1.5 mm. In case where the material composing the face portion 3 of the head body 1 is iron alloy, the thickness of iron alloy of the face portion 3 is preferably equal or inferior to 2.5 mm, more preferably equal or inferior to 2.0 mm, and still more preferably equal or inferior to 1.5 mm, setting the lower limit value thereof to 1.0 mm. In case where the material composing the face portion 3 of the head body 1 is aluminum alloy, the thickness of aluminum alloy of the face portion 3 is preferably equal or inferior to 4.0 mm, more preferably equal or inferior to 3.5 mm, and still more preferably equal or inferior to 3.0 mm, setting the lower limit value thereof to 2.0 mm.

Thus, it becomes possible to further improve the repulsion by thinning the metallic portion of the face portion 3. Besides, a sufficient durability can be secured by the presence of the reinforcement 7, even when the metallic portion of the face portion 3 is thinned as mentioned above.

For the aforementioned holes 2*a*, 4*a*, the shape thereof is not particularly determined. For instance, the hole 2*a* of the crown portion 2 can take various shapes as shown in FIG. 3(*a*) to FIG. 3(*o*). However, in the head plan view, it is preferable to set the area of the hole 2*a* in a range of 40 to 90% of the area of the crown portion 2. It becomes possible to improve further the degree of design freedom by setting within the range. Here, the area of the crown portion is the surface area of a portion surrounded by the edge of the side portion, the edge of the face portion and the edge of the neck portion. Similarly, in the head bottom view, it is preferable to set the area of the hole 4*a* in a range of 40 to 90% of the area of the sole portion 4. It becomes possible to improve further the degree of design freedom by setting within the range. Here, the area of the sole portion is the surface area of a portion surrounded by the edge of the side portion and the edge of the face portion. Besides, in case where the edge is not clear, it is also possible to know edges of the side portion, face portion, crown portion and sole portion, by cutting the golf club head and examining the bonding portion of the inner face. Further, if the edge of the crown portion is not clear, the projected area of a golf club head excluding the hitting surface looked down from vertically upward in respect to a plane may be used while the golf club is put on the plane with the hitting surface adjusted to the loft angle of the golf club head.

Though the aforementioned flanges 2*b*, 4*a* are not necessarily required, preferably it exists at least on a part of the peripheral edge of the crown portion 2 and the sole portion 4, more preferably it exists at least on the face side of the head body 1, and still more preferably all around the peripheral edge. In short, the disposition of the flanges 2*b*, 4*b* in appropriate areas of the head body 1 permits to secure the durability of the head body 1 and, at the same time, to use the flanges 2*b*, 4*b* as overlap margin for the cover member 6.

It is preferable that the aforementioned cover member 6 is superimposed on the flanges 2*b*, 4*b* at least on the face side of the head body 1. In this case, the cover member 6 may cover a part of the flange 2*b* on the face side, as shown in FIG. 4(*a*) and FIG. 4(*b*), or, the cover member 6 may cover all over the flange 2*b* on the face side, as shown in FIG. 4(*c*) and FIG. 4(*d*). The width t1 of the overlap margin for the flange 2*b* on the face side of the cover member 6 is preferably equal or superior to 5 mm. It becomes possible to secure a sufficient durability by setting the width t1 of the overlap margin equal or superior to 5 mm. Besides, the width t2 of flange 2*b* on the face side is satisfactory if it is equal or superior to 5 mm and less than 30 mm. In case where the cover member 6 is superimposed on the flange 4*b* of the sole portion 4, it is preferable to select a laminating mode and dimensions similar to the aforementioned.

Figure 6A:
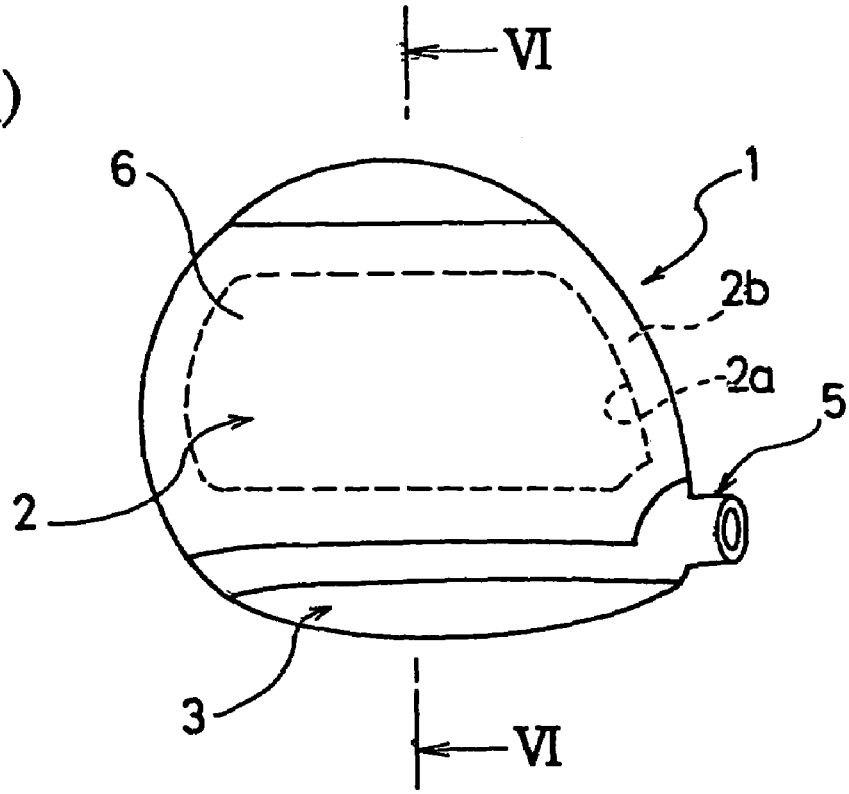
FIG. 6(*a*) and FIG. 6(*b*) show variants of golf club head of the present invention.
Figure 6B:
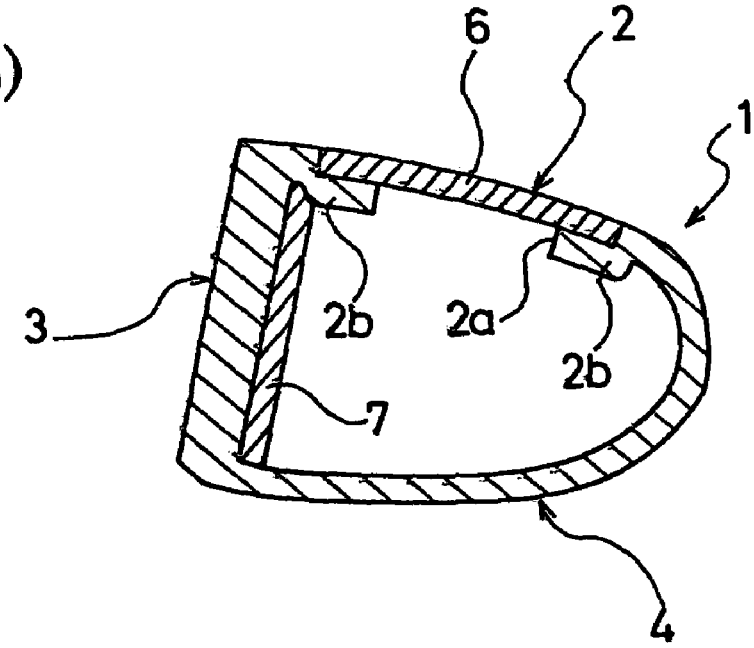
Figure 7A:
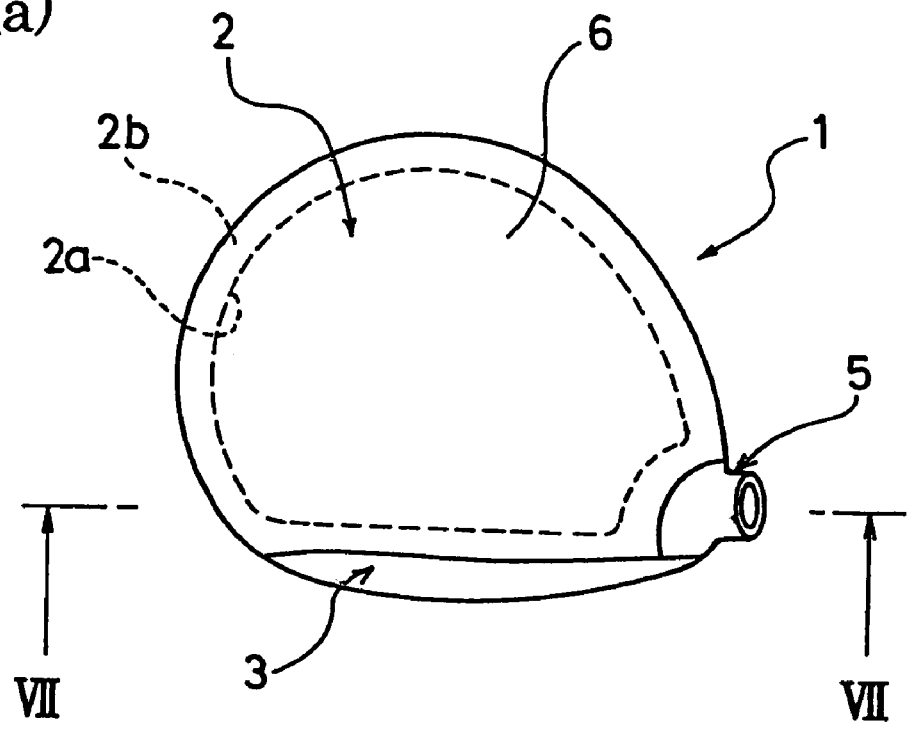
FIG. 7(*a*) and FIG. 7(*b*) show variants of golf club head of the present invention.
Figure 7B:
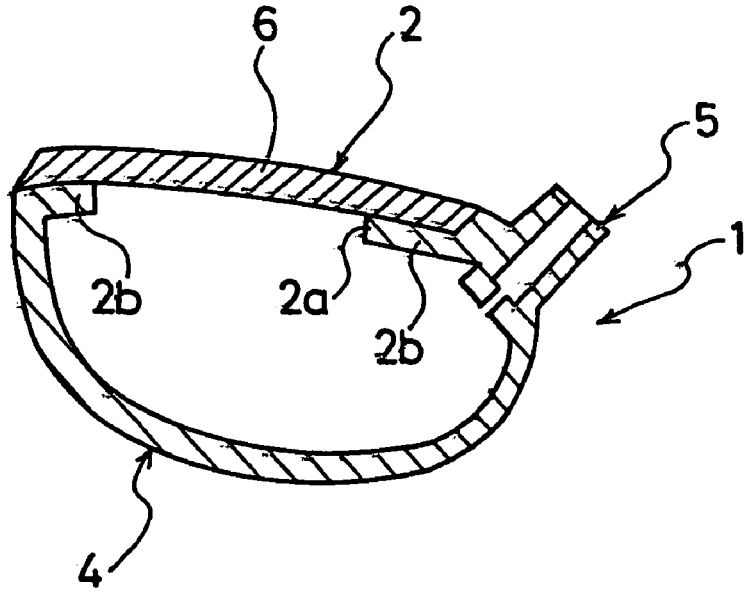
Figure 8A:
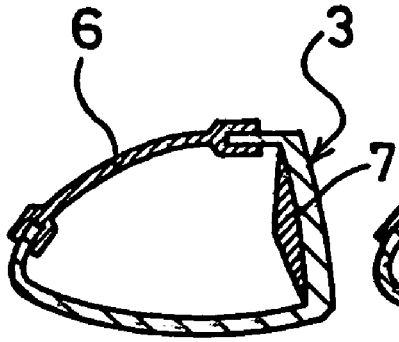
FIG. 8(*a*) to FIG. 8(*h*) are cross sectional view showing respectively variants of golf club head of the present invention.
Figure 8B:
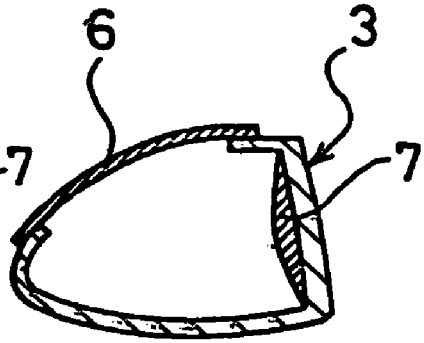
Figure 8C:
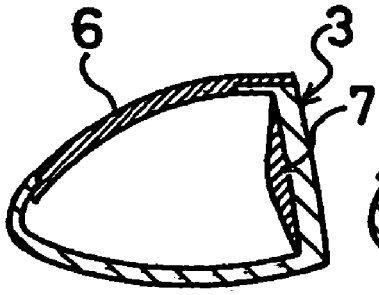
Figure 8D:
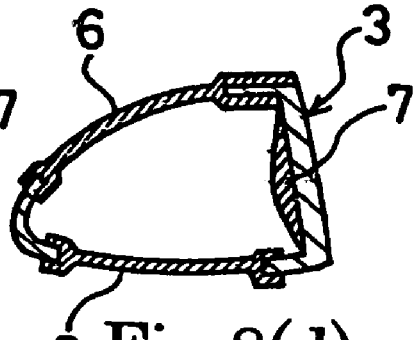
Figure 8E:
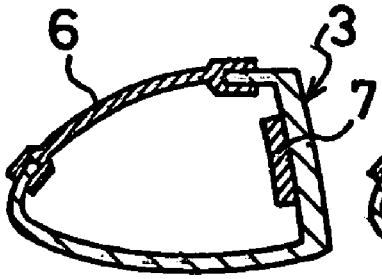
Figure 8F:
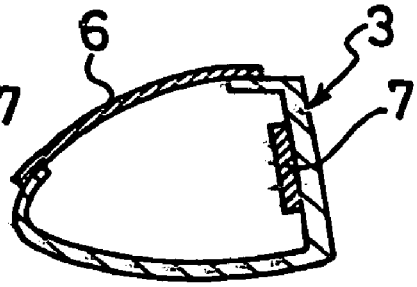
Figure 8G:
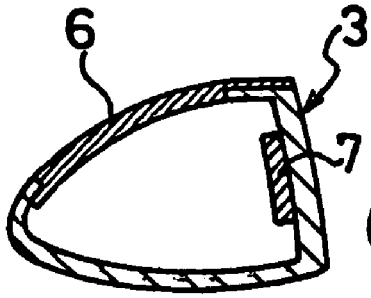
Figure 8H:
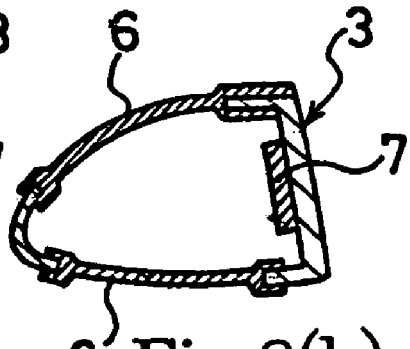
Figure 9A:
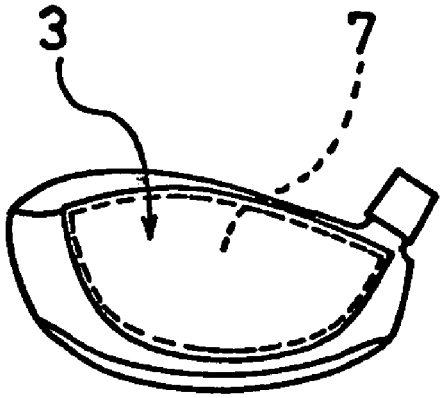
FIG. 9(*a*) to FIG. 9(*f*) are front view showing respectively variants of golf club head of the present invention.
Figure 9B:
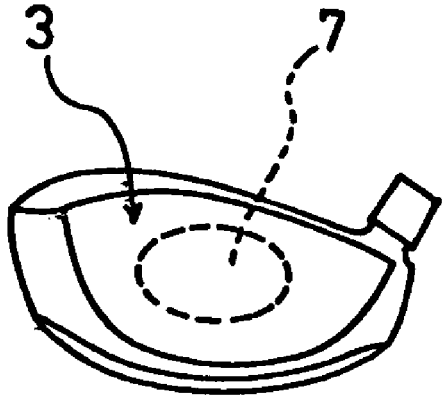
Figure 9C:
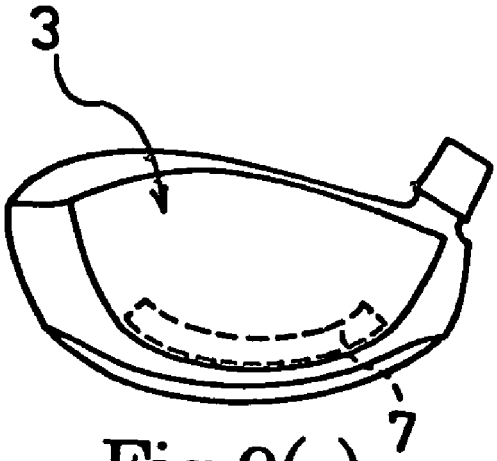
Figure 9D:
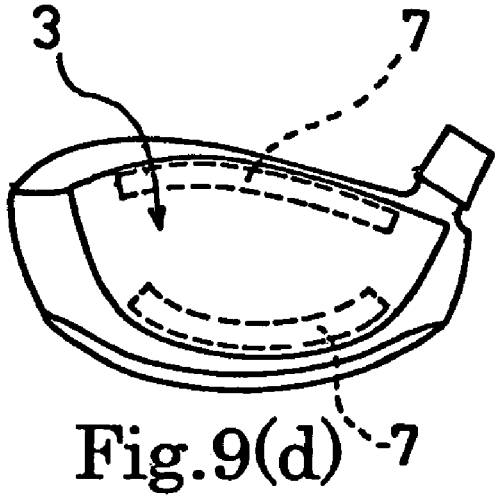
Figure 9E:
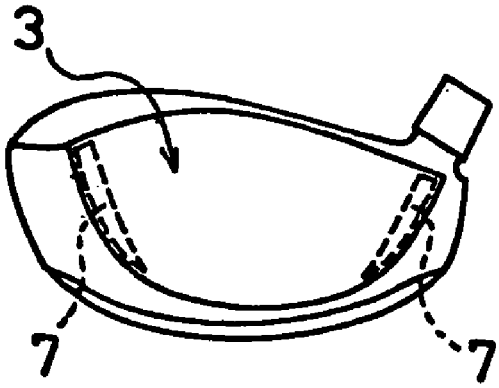
Figure 9F:
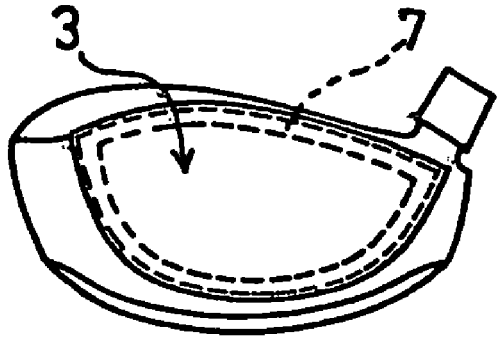

The affixation mode of the cover member 6 to the head body 1 is not especially determined. For instance, in FIG. 1(*c*) and FIG. 2(*c*), the peripheral edge portion of the cover portion 6 is divided into two layers, and the flanges 2*b*, 4*b* are pinched from inside and outside in this portion; however, the cover member 6 may be affixed to one face of the flange 2*b* as shown in FIG. 5(*a*) to FIG. 5(*d*), or, the cover member 6 may be affixed to the end face of the face portion 3 without intermediate of flange as shown in FIG. 5(*e*). Otherwise, the flange 2*b* may be provided in a way to receive the cover member 6, in a portion of the head body 1 to be bonded with the cover member 6, as shown in FIG. 6(*a*) and FIG. 6(*b*) or FIG. 7(*a*) and FIG. 7(*b*).

As for the material of the cover member 6, it is preferable to use a fiber reinforced plastic. As the fiber reinforced plastic, a fiber reinforced plastic made by impregnating carbon fiber, glass fiber, alamido fiber or other reinforced fiber with epoxy resin, unsaturated polyester resin, vinyl ester resin or other matrix resin, can be cited and, especially, those having carbon fiber as reinforced fiber are preferable.

It can also be made to use magnesium alloy, aluminum alloy or titanium alloy, as material of the cover member 6 and, in certain cases, in addition to the hard rubber, nylon resin, ionomer resin, polycarbonate resin, PET resin, ABS resin or the like may also be used.

Whichever material should be used, it is preferable to make the total mass Wf of the cover member 6 closing the holes 2*a*, 4*a* lighter than the total mass Wx of the removed portion of the head body 1 determined from the product of the virtual area and the virtual thickness of the holes 2*a*, 4*a* and the specific gravity ρm of the head body 1, namely Wx>Wf, in order to secure the weight margin.

For instance, in case where the hole 2*a* is formed in the vicinity of the middle of the crown portion 2, the flange 2*b* is formed all around the peripheral edge of the crown portion 2, and a cover member 6 is affixed to the outside of the crown portion 2, the total mass Wf of the cover member 6 will be Wf=Af·ρf·tf from the area Af, specific gravity ρf and thickness tf of the cover member 6. On the other hand, the total mass Wx of the removed portion will be Wx=(Af−Am)·ρm·tm from the area Am of the overlapped portion of the cover member 6 and the head body 1, specific gravity ρm of the head body 1 and average thickness tm of the crown portion and sole portion of the head body 1 in the overlapped portion. In short, the virtual area of the holes 2*a*, 4*a* can be determined from the difference of the area Af of the cover member 6 and the area Am of the overlapped portion, and the virtual thickness of the holes 2*a*, 4*a* can be considered as equivalent to the average thickness tm of the crown portion and sole portion of the head body 1 in the overlapped portion.

The affixation mode of the reinforcement 7 to the head body 1 is not especially determined. For instance, in FIG. 1(*c*) and FIG. 2(*c*), though the reinforcement 7 is disposed all over the face area, the reinforcement 7 may also be disposed all over the face area and, at the same time, the thickness thereof may be reduced gradually from the face central portion to the peripheral edge portion, as shown in FIG. 8(*a*) to FIG. 8(*d*), or, the reinforcement 7 may also be disposed only in the face central portion as shown in FIG. 8(*e*) to FIG. 8(*h*). In addition, FIG. 9(*a*) to FIG. 9(*f*) illustrate the disposition of the reinforcement viewed from the head front face, and the reinforcement 7 may also be disposed only around the peripheral edge portion as shown in FIG. 9(*c*) to FIG. 9(*f*).

As for fiber reinforced plastic composing the reinforcement 7, a fiber reinforced plastic made by impregnating carbon fiber, glass fiber, alamido fiber or other reinforced fiber with epoxy resin, unsaturated polyester resin, vinyl ester resin or other matrix resin, can be cited and, especially, those having carbon fiber as reinforced fiber are preferable. However, the coefficient of elasticity of the fiber of the fiber reinforced plastic composing the reinforcement 7 is preferably equal or less than 35 tons/mm$^2$, and more preferably equal or less than 24 tons/mm$^2$. It becomes possible to secure a more satisfactory durability, by setting the coefficient of elasticity within the aforementioned range.

Figure 10A:
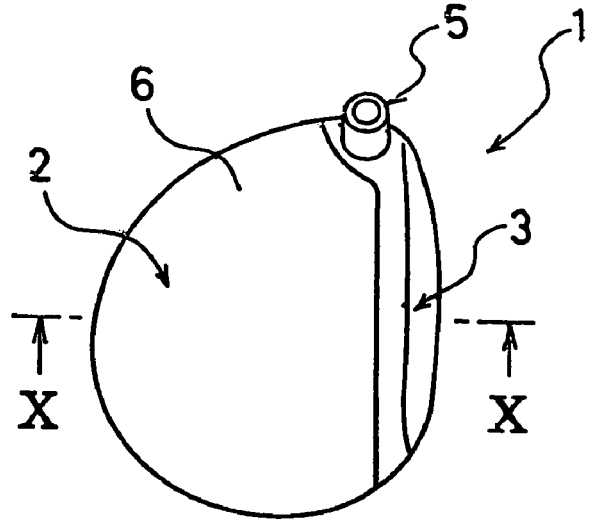
FIG. 10(*a*) to FIG. 10(*c*) show a golf club head made of a third embodiment of the present invention.
Figure 10B:
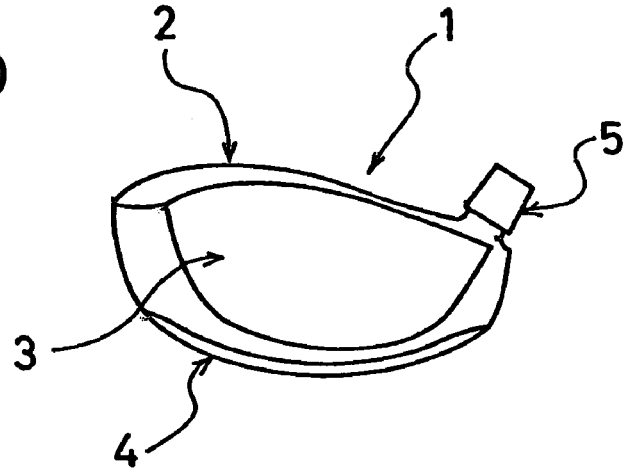
Figure 10C:
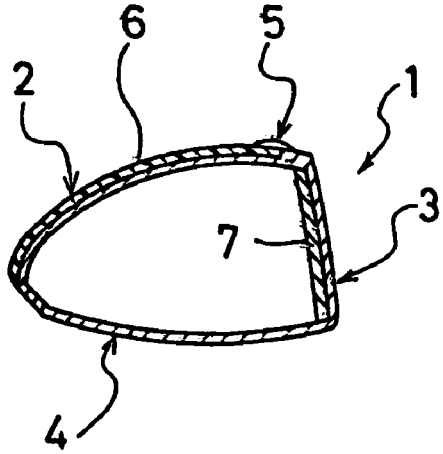

FIG. 10(*a*) to FIG. 10(*c*) show a golf club head made of a third embodiment of the present invention. As shown in FIG. 10(*a*) to FIG. 10(*c*), the golf club head of the present embodiment has a hollow structure, the head body 1 thereof is composed of a metal such as titanium alloy, aluminum alloy, stainless steel or the like. The head body 1 comprises a crown portion 2, a face portion 3, a sole portion 4 and a neck portion 5, and a cover member 6 is laminated on the outer surface of the crown portion 2. Besides, the inside of the face portion 3 of the head body 1 is laminated with a reinforcement 7 made of a fiber reinforced plastic. In short, a part of the crown portion 2 and a part of the face portion 3 are made of a material different from the head body 1.

There, the ratio (ρb/ρc) of the specific gravity ρb of a portion of the head body 1 excluding the crown portion 2 and the face portion 3 and the specific gravity ρc of the crown portion 2 is set equal or superior to 1.3. Here, the area of the crown portion is the portion surrounded by the edge of the side portion, edge of the face portion and edge of the neck portion. On the other hand, the face portion is the portion surrounded by the edge of the crown portion, the edge of the side portion and the edge of the sole portion. In case where the edge is not clear, it is also possible to know edges of the side portion, face portion, crown portion and sole portion, by cutting the golf club head and examining the bonding portion of the inner face. Further, if the edge of the crown portion is not clear, the edge of the crown portion can be known by the profile line excluding the hitting surface looked down from vertically upward in respect to a plane while the golf club is put on the plane with the hitting surface adjusted to the loft angle of the golf club head.

Thus, it becomes possible to secure a satisfactory weight margin, by the fact that at least a part of the crown portion 2 and at least a part of the face portion 3 of the head body 1 are composed of a material different from the head body, and the ratio (ρb/ρc) of the specific gravity ρb of a portion of the head body 1 excluding the crown portion 2 and face portion 3 and the specific gravity ρc of the crown portion 2 is set equal or superior to 1.3. Consequently, the degree of design freedom is increased compared to a case of composing solely with a single metallic material and, as a result, it becomes possible to increase the repulsion by lowering the center of gravity.

In the present embodiment, the portion of the head body 1 excluding the crown portion 2 and face portion 3 and the crown portion 2 may be composed of a single material, or, may be composed of a composite material. In case of composing from a composite material, the specific gravity ρb and the specific gravity ρc correspond to the specific gravities of the portion of the head body 1 excluding the crown portion 2 and face portion 3 and the crown portion 2 respectively.

As for the hollow golf club head whose head body is formed from a metal, a conventional example 1 (example of the prior art) made of a single metallic material and, embodiment examples 1 to 4 and comparative examples 1 to 3 where holes are formed in the vicinity of the middle of the crown portion and the sole portion, and the holes are closed respectively with a cover member made from different materials, and at the same time, the inside of the face portion of the head body is laminated with a reinforcement made of a fiber reinforced plastic, were prepared respectively. In Table 1, "SUS alloy" means stainless steel, "FRP" fiber reinforced plastic, "GFRP" glass fiber reinforced plastic, and "CFRP" carbon fiber reinforced plastic.

EXAMPLE

Coefficient of restitution and degree of design freedom were evaluated for these golf club heads and the results thereof are shown together in Table 1. The results of evaluation are indicated by the index by taking the conventional example 1 as 100. The repulsion coefficient means that the higher is the index value, the higher is the ball initial velocity and larger is the flight distance. The degree of design freedom is the weight margin when the head total mass is set at 190 g and means that higher is the index value, higher is the weight margin. For the durability, the higher is the index value, the better is the durability.

| | pm/pf | Material of head body | Material of cover member | Position of hole | Face combined area ratio (%) | Metallic part efface portion Material | Metallic part efface portion Thickness | Reinforcement of face portion Material | Reinforcement of face portion Thickness | Repulsion coefficient | Degree of design freedom elasticity | Durability |
|---|---|---|---|---|---|---|---|---|---|---|---|---|
| Conventional example 1 | 1.0 | Ti alloy | Ti alloy | | | Ti alloy | 2.8 mm | | | 100 | 100 | 100 |
| Embodiment 1 | 2.9 | Ti alloy | FRP | Crown | 85 | Ti | 2.6 mm | GFRP | 0.6 mm | 102 | 111 | 105 |
| Comparative example 1 | 2.9 | Ti alloy | FRP | Crown | 12 | Ti alloy | 2.6 mm | GFRP | 0.6 mm | 96 | 111 | 96 |
| Comparative example 2 | 0.6 | Ti alloy | SUS | Crown | 85 | Ti | 2.6 mm | GFRP | 0.6 mm | 93 | 93 | 96 |
| Embodiment 2 | 2.9 | Ti alloy | FRP | Crown, sole | 85 | Ti alloy | 2.6 mm | GFRP | 0.6 mm | 104 | 121 | 103 |
| Comparative example 3 | 0.6 | Ti alloy | SUS alloy | Crown, sole | 12 | Ti alloy | 2.6 mm | GFRP | 0.6 mm | 83 | 83 | 94 |
| Embodiment 3 | 4.9 | Fe alloy | FRP | Crown | 70 | Fe | 2.2 mm | G + CFR | 0.5 mm | 109 | 106 | 104 |
| Embodiment 4 | 1.7 | Al alloy | FRP | Crown | 65 | Al | 3.5 mm | G + CFR | 0.5 mm | 107 | 115 | 103 |

As it is understood from the Table 1, for every golf club head of the embodiment examples 1 to 4, compared to conventional example 1, the degree of design freedom was large, and the repulsion coefficient was large, while maintaining the durability. For the comparative examples 1 and 3 the durability was deteriorated, because the face combined area ratio was too low. For the comparative examples 2 and 3 the degree of design freedom was small, and the repulsion coefficient was low, because the specific gravity of the cover member was too high.

According to the present invention, in a hollow golf club head whose head body is made of a metal, the repulsion can be increased and the degree of design freedom can be increased compared to a case of composing solely with a single metallic material, by providing a hole in the vicinity of the middle of the crown portion of the head body, closing the hole with a cover member made of a material different from the head body, setting the ratio ($\rho m/\rho f$) of the specific gravity $\rho m$ of the head body and the specific gravity $\rho f$ of the cover member equal or superior to 1.3, the face portion of the head body is laminated with a reinforcement made of a fiber reinforced plastic, and the ratio of the face area of a portion where the reinforcement and the head body are combined to the face area of the head body is set equal or superior to 20%.

Further, in a hollow golf club head whose head body is made of a metal, the repulsion can be increased and the degree of design freedom can be increased compared to a case of composing solely with a single metallic material, by the fact that at least a part of the crown portion and a part of the face portion of the head body are composed of a material different from the head body, and the ratio ($\rho b/\rho c$) of the specific gravity $\rho b$ of the portion of the head body excluding the crown portion and face portion and the specific gravity $\rho c$ of the crown portion is set equal or superior to 1.3.

Hereinabove, preferable embodiments of the present invention have been described in detail; however, it should be understood that various modifications, replacements or substitutions can be applied to the same, to the extent not to depart from the spirit and the scope of the present invention which is defined by the attached claims.

What is claimed is:

1. A hollow golf club head comprising a hollow head body having a crown portion, a face portion, a sole portion and a neck portion, wherein all of said portions are made of metal and wherein a part of the crown portion and a part of the face portion of the head body are composed of a material different from said metal, said part of the crown portion being located on an outer surface of the crown portion and said part of the face portion being located on an inner surface of the face portion and a ratio (pb/pc) of a specific gravity pb of a portion of said head body excluding the crown portion and the face portion and a specific gravity pc of said crown portion including said part thereof is set equal to or greater than 1.3.

2. The hollow golf club head of claim 1, wherein said part of the crown portion and said part of the face portion are made of a fiber reinforced plastic material.

* * * * *